US008439341B2

(12) United States Patent
Ishikawa et al.

(10) Patent No.: US 8,439,341 B2
(45) Date of Patent: May 14, 2013

(54) SHEET BUNDLE TREATMENT APPARATUS CONFIGURED TO PERFORM PROCESSES ON CREASE OF FOLDED SHEET BUNDLE

(75) Inventors: Naoki Ishikawa, Kashiwa (JP); Yasuo Fukatsu, Abiko (JP); Hitoshi Kato, Toride (JP); Tomoharu Sato, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 11 days.

(21) Appl. No.: 13/300,959

(22) Filed: Nov. 21, 2011

(65) Prior Publication Data

US 2012/0142510 A1 Jun. 7, 2012

(30) Foreign Application Priority Data

Dec. 7, 2010 (JP) ..... 2010-272700

(51) Int. Cl.
*B31F 1/10* (2006.01)

(52) U.S. Cl.
USPC ..... 270/45; 270/58.07

(58) Field of Classification Search ..... 270/32, 270/45, 51, 58.07; 493/406, 407, 442, 454
See application file for complete search history.

(56) References Cited

U.S. PATENT DOCUMENTS 6,905,118 B2 * 6/2005 Yamada et al. ..... 270/8
7,607,650 B2 10/2009 Oikawa et al.

* cited by examiner

*Primary Examiner* — Leslie A Nicholson, III
(74) *Attorney, Agent, or Firm* — Canon USA, Inc., IP Division

(57) ABSTRACT

A sheet bundle treatment apparatus may include a folding device, a conveying unit, a flattening device, and a control unit. The folding device performs a folding process on a sheet bundle to produce a folded sheet bundle. The conveying unit conveys the folded sheet bundle. The flattening device performs a flattening process to press a folded portion of the sheet bundle from the folded portion toward a fore edge to flatten the folded portion after the conveyance of the sheet bundle. The control unit causes the sheet bundle to be conveyed at a first velocity when the flattening process is not to be performed, and causes the sheet bundle to be conveyed at a second velocity which is slower than the first velocity when the flattening process is to be performed, thereby stopping the sheet bundle at a position where the flattening process is to be performed.

7 Claims, 15 Drawing Sheets

SHEET BUNDLE TREATMENT APPARATUS CONFIGURED TO PERFORM PROCESSES ON CREASE OF FOLDED SHEET BUNDLE

BACKGROUND OF THE INVENTION

1. Field of the Invention

The present invention relates to a sheet bundle treatment apparatus configured to perform center folding on a plurality of sheets.

2. Description of the Related Art

A sheet bundle treatment apparatus configured to bind a booklet by performing a saddle-stitch binding process and a center folding process on sheet bundles having a plurality of sheets on which images are formed by an image forming device is widely provided. When the center folding process is performed on a sheet bundle by the sheet bundle treatment apparatus as described above, a folded portion of the sheet bundle may be bulged and hence foldability may become insufficient. In particular, when the thickness of each sheet becomes large, the desired folded portion might not be formed, which may results in a low appearance quality of bound booklets.

Therefore, in U.S. Pat. No. 7,607,650, a pressing process to fortify a crease of the folded portion by press rollers which move along the folded portion of the sheet bundle while nipping the portion from both front and rear surfaces is performed after the center folding process. In U.S. Pat. No. 7,607,650, a flattening process is also performed to flatten a bulged part of a folded portion, or spine, of the sheet bundle by moving a flattening roller along the bulged part of the sheet bundle while pressing the portion. By selectively performing these processes, the appearance quality of the created bound booklet is improved.

In U.S. Pat. No. 7,607,650, when the flattening process or the pressing process is performed, an accuracy of positioning of the sheet bundle is enhanced by causing the sheet bundle being conveyed to abut against a retractable stopper. However, a motor or the like to move the stopper is additionally required, which leads to cost increase.

In order to achieve a stop position, to which the sheet bundle is conveyed, with high degree of accuracy without using the stopper, a timing to stop the motor that conveys the sheet bundle may be controlled with high degree of accuracy. In order to enhance the accuracy of the stop position of the sheet bundle, the velocity of conveyance of the sheet bundle to the position may be lowered. However, lowering of productivity is also resulted correspondingly.

SUMMARY OF THE INVENTION

The invention provides a sheet bundle treatment apparatus which is capable of preventing a sheet bundle to be bound from being unsatisfactorily finished without increasing cost and reducing productivity.

The invention will become further apparent from the description with reference to the drawings given below.

According to a first aspect of the invention, there is provided a sheet bundle treatment apparatus including a folding device configured to perform a folding process on a sheet bundle including a plurality of sheets to produce a folded sheet bundle, a conveying unit configured to convey the folded sheet bundle, a flattening device configured to perform a flattening process to press a folded portion of the sheet bundle from the folded portion toward a fore edge to flatten the folded portion after the conveyance of the sheet bundle by the conveying unit, and a control unit configured to cause the sheet bundle to be conveyed at a first velocity when the flattening process is not to be performed, and to cause the sheet bundle to be conveyed at a second velocity which is slower than the first velocity when the flattening process is to be performed, thereby controlling the conveying unit to stop the sheet bundle at a position where the flattening process is to be performed.

Further features of the present invention will become apparent from the following description of exemplary embodiments with reference to the attached drawings.

DESCRIPTION OF THE EMBODIMENTS

First Embodiment

Figure 1:
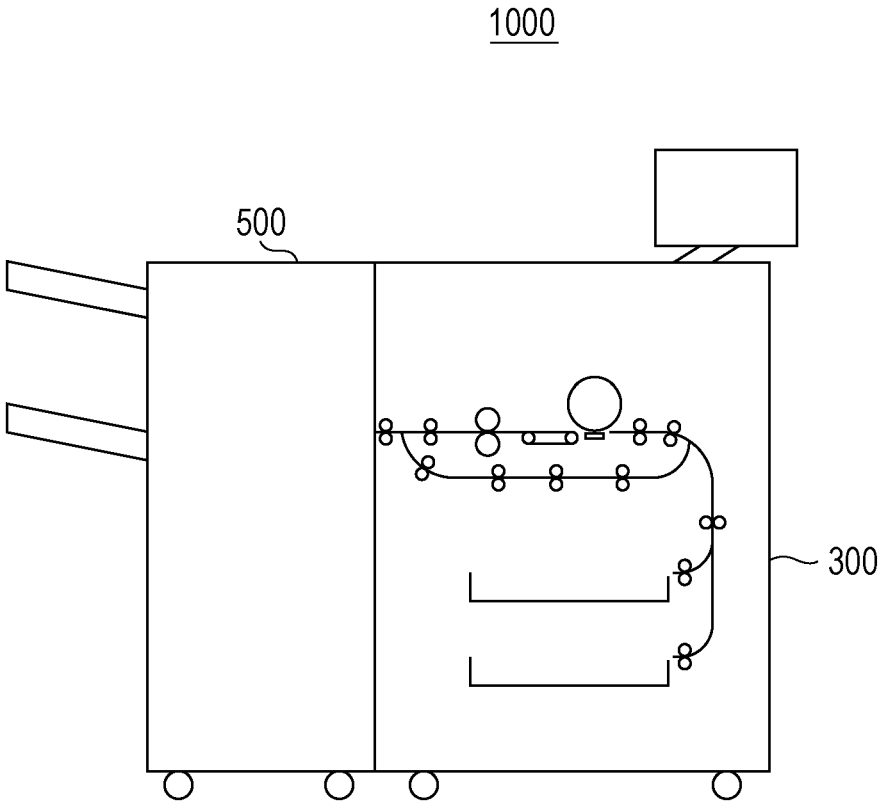
FIG. 1 is an explanatory cross-sectional view showing an image forming system.

FIG. 1 is a drawing roughly showing an image forming system 1000. The image forming system 1000 includes a printer 300 and a finisher 500 as a sheet bundle treatment apparatus. The finisher 500 receives a sheet on which an image is formed by the printer 300, and performs processes on the received sheet. The processes include a process of aligning a plurality of sheets and bundling the sheets as a single sheet bundle, a stapling process (binding process) for stapling the sheet bundle, a punching process for punching on a rear end side of the sheet bundle, a sorting process for sorting the sheets, and a saddle-stitch binding process.

Figure 2:
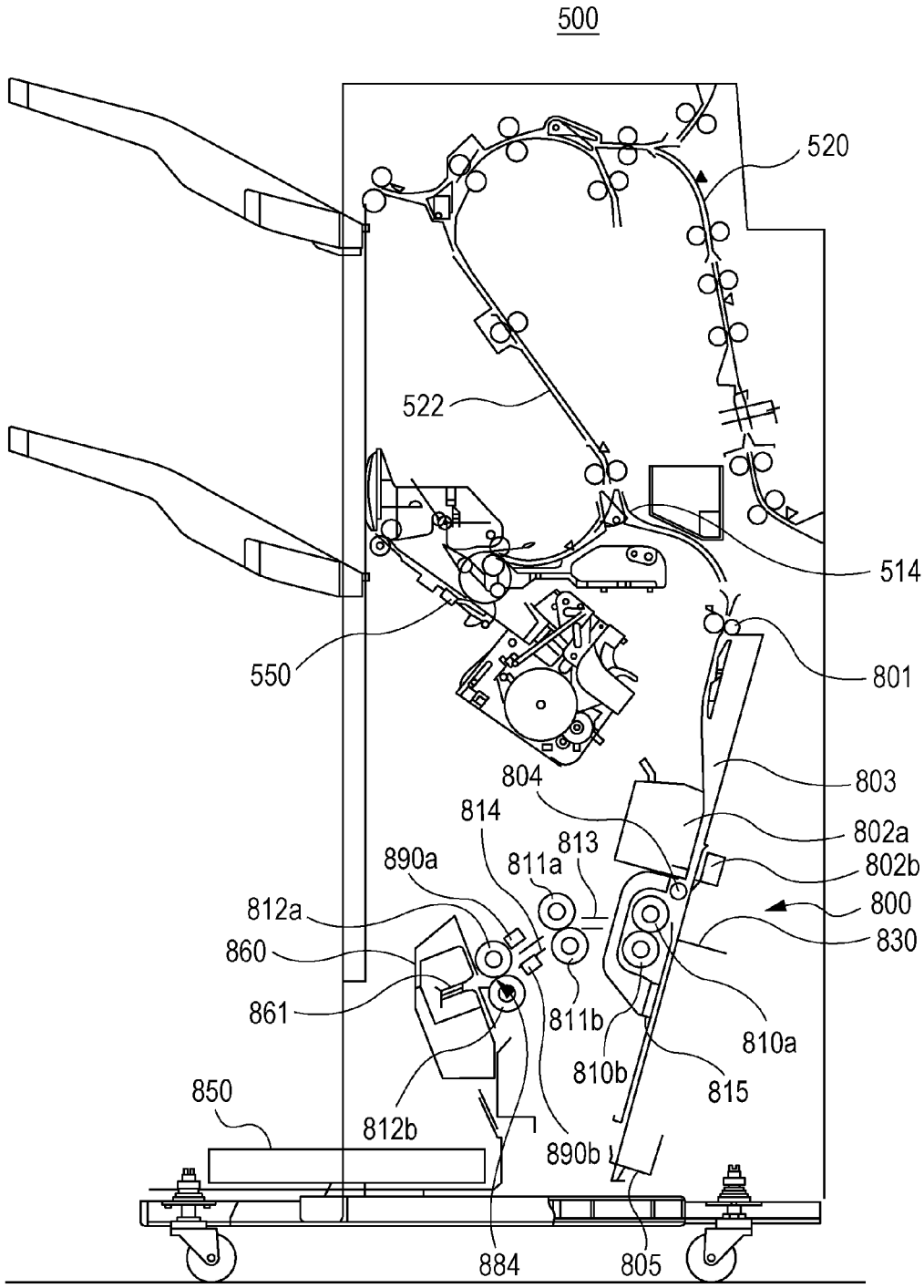
FIG. 2 is a cross-sectional view showing a configuration of a finisher.

FIG. 2 is a cross-sectional view showing the finisher 500 in detail. A sheet discharged from the printer 300 is conveyed through a conveying path 520. A conveying route of the sheet conveyed through the conveying path 520 is switched either to a conveying path 521 or a conveying path 522 by a flapper 513. The conveying route of the sheet conveyed to the conveying path 522 is switched either to a process tray 550 or a saddle-stitch binding unit 800 by a flapper 514.

Subsequently, a configuration of the saddle-stitch binding unit 800 will be described. The sheet to be conveyed to the saddle-stitch binding unit 800 is received by a roller pair 801 at an entry of a saddle, and is carried into a storage guide 803 as a storage unit. The conveyed sheet is conveyed by a roller 804 until a leading edge comes into contact with a movable sheet positioning member 805. A stapler 802 is provided in the vicinity of the storage guide 803. The stapler 802 includes a driver 802*a* that pushes out needles and an anvil 802*b* that bends the pushed-out needle. The sheet positioning member 805 is positioned so that the center of the carried sheet in the direction of conveyance comes to a stapling position of the stapler 802. The sheet positioning member 805 is moved by a sheet positioning motor 905 described later, and the position can be changed according to the sheet size.

Provided on the downstream side of the stapler 802 is a folding roller pair 810 including folding rollers 810*a* and 810*b*, and a pushing member 830 is provided at a position facing a nip of the folding roller pair 810. The sheet positioning member 805 moves downward so that a stapled position of the sheet bundle bound by the stapler 802 is aligned with a position of the nip of the folding roller pair 810. The pushing member 830 has a home position which is retracted from the storage guide 803, and is moved by a pushing motor 906, described later. By the pushing member 830 pushing the stored sheet bundle, the sheet bundle is folded by being pushed into the nip of the folding roller pair 810*a* and 810*b*. The pushing member 830 then returns back to the home position. A pressure F1 sufficient for wimpling the bundle is applied to the nip of the folding roller pair 810 by a spring, not shown. The wimpled sheet bundle is conveyed by a first folding and conveying roller pair 811 including first folding and conveying rollers 811*a* and 811*b* and a second folding and conveying roller pair 812 including second folding and conveying rollers 812*a* and 812*b* along conveyance guides 813 and 814. The first folding and conveying roller pair 811 and the second folding and conveying roller pair 812 are also applied with pressures F2 and F3, respectively sufficient to convey the wimpled sheet bundle or hold the sheet bundle in a resting state. The folding roller pair 810, the first folding and conveying roller pair 811, and the second folding and conveying roller pair 812 are rotated by a folding and conveying motor 907, described later, at a constant velocity. Arranged in the vicinity of the second folding and conveying roller pair 812 is a sheet bundle detecting sensor 884 configured to detect the conveyed sheet bundle.

Since the above-described pushing motor 906 and the folding and conveying motor 907 are required to provide a strong force to perform the processes on the sheet bundle, DC motors having an efficiency higher than a pulse motor are used.

An aligning plate 815 aligns the sheets stored in the storage guide 803 in the width direction. Provided between the first folding and conveying roller pair 811 and the second folding and conveying roller pair 812 is a clamping unit 890 made up of clamping members 890*a* and 890*b* configured to clamp and hold the sheet bundle from a front cover side and a rear cover side. The clamping member 890*b* is fixed, and the clamping member 890*a* is configured to be movable upward and downward so that clamping of the sheet bundle and retraction of the clamping member 890*a* are achieved. The upward and downward movement of the clamping member 890*a* is moved by a clamping motor 909 described later. Provided on the downstream of the second folding and conveying roller pair 812 is a press unit 860 that performs a pressing process that fortifies a crease and a flattening process for flattening the crease. The sheet bundle after having subjected to the processes is discharged to a discharge tray 850.

Figure 3:
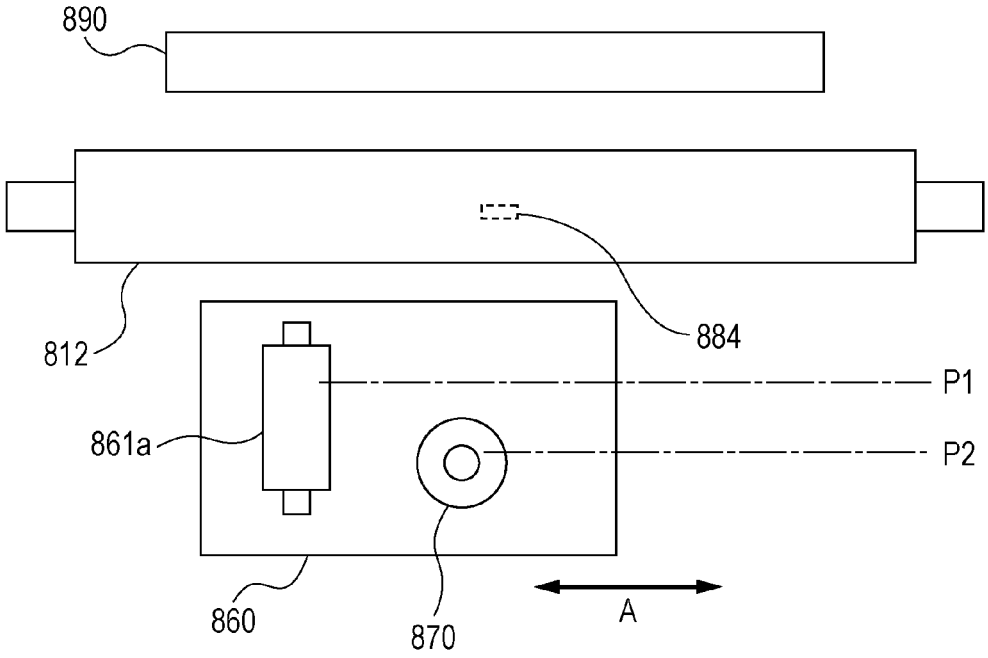
FIG. 3 is a top view of a press unit.

FIG. 3 is a plan view of the press unit 860 and the like viewed from above the apparatus. Provided on the upstream of the second folding and conveying roller pair 812 is the clamping unit 890. Arranged at a center portion of the second folding and conveying roller pair 812 is the sheet bundle detecting sensor 884 for detecting the sheet bundle. The press unit 860 is provided on the downstream of the second folding and conveying roller pair 812, and the press unit 860 performs a process for a folded portion of the sheet bundle by moving in the direction indicated by an arrow A. The press unit 860 is provided with press rollers 861*a* and 861*b* and a flattening roller 870. The press rollers 861*a* and 861*b* are arranged so as to be capable of clamping the folded portion of the sheet bundle from both surfaces of the sheet bundle, and is movable in the direction orthogonal to the direction of conveyance of the sheet bundle. In other words, the axial direction of the press rollers 861*a* and 861*b* matches the direction of conveyance of the sheet bundle. By the movement of the press unit 860 along the crease in a state in which the press rollers 861*a* and 861*b* press the crease from the both surfaces of the sheet bundle, the crease is fortified. The flattening roller 870 is arranged so as to be capable of flattening the folded portion of the sheet bundle toward the direction opposite from the direction of conveyance of the sheet bundle (from the folded portion toward a fore edge), and is movable in the direction orthogonal to the direction of conveyance of the sheet bundle along the folded portion. The term "fore edge" means an end of the sheet bundle opposite from the folded portion. By the movement of the press unit 860 along the folded portion in a state in which the sheet bundle is pressed by the flattening roller 870 from the upstream side of the direction of conveyance, the cross-section of the folded portion of the sheet is flattened into the shape similar to a bracket shape. The clamping unit 890 holds the sheet bundle and fixes the sheet bundle in order to prevent the sheet bundle from moving in the direction opposite from the direction of conveyance when the flattening roller 870 flattens the folded portion.

The rollers to be used for performing the process on the folded portion of the sheet bundle may be selected between the press roller pair 861 only and both of the press roller pair 861 and the flattening roller 870. A position P1 is a position at which the sheet bundle comes into contact with the press roller pair 861 and does not contact with the flattening roller 870. A position P2 is a position at which the sheet bundle comes into contact both with the press roller pair 861 and the flattening roller 870. Therefore, when the sheet bundle is stopped at the position P1, the pressing process is performed on the folded portion by the press roller pair 861, and when the sheet bundle is stopped at the position P2, both of the pressing process and the flattening process are performed on the folded portion by the press roller pair 861 and the flattening roller 870. The closer a stop position of the sheet bundle to an axis of the flattening roller 870, the larger the amount of flattening of the folded portion. At the time of flattening process, the pressing process is performed also by the press roller pair 861. Therefore, when the flattening process is selected, two processes, namely, the pressing process and the flattening process are performed.

Figure 15:
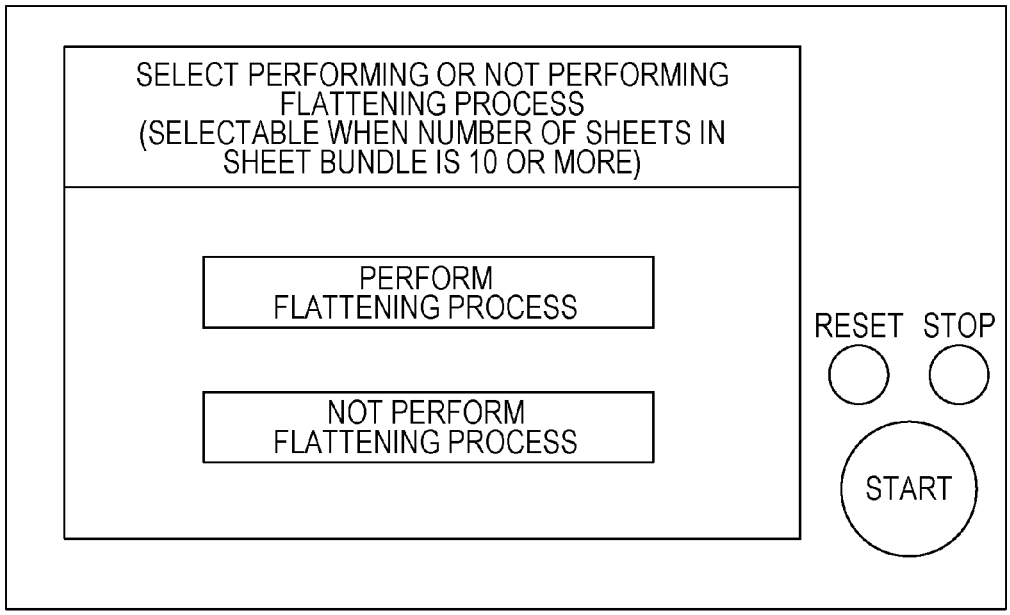
FIG. 15 is an explanatory drawing showing an operation panel of the image forming system.

In this embodiment, the flattening process on the folded portion by the flattening roller 870 is adapted to be executable when the number of sheets which constitute the sheet bundle is ten or more. When the number of sheets of the sheet bundle is too small, it is difficult to flatten the folded portion into the bracket shape in terms of the thickness of the sheet bundle, so that the quality of the folded portion of the sheet ends up being lowered by performing the flattening process. Therefore, when the number of sheets of the sheet bundle is 10 or more, a user is allowed to set to perform the flattening process via a manipulating portion shown in FIG. 15.

Figure 4:
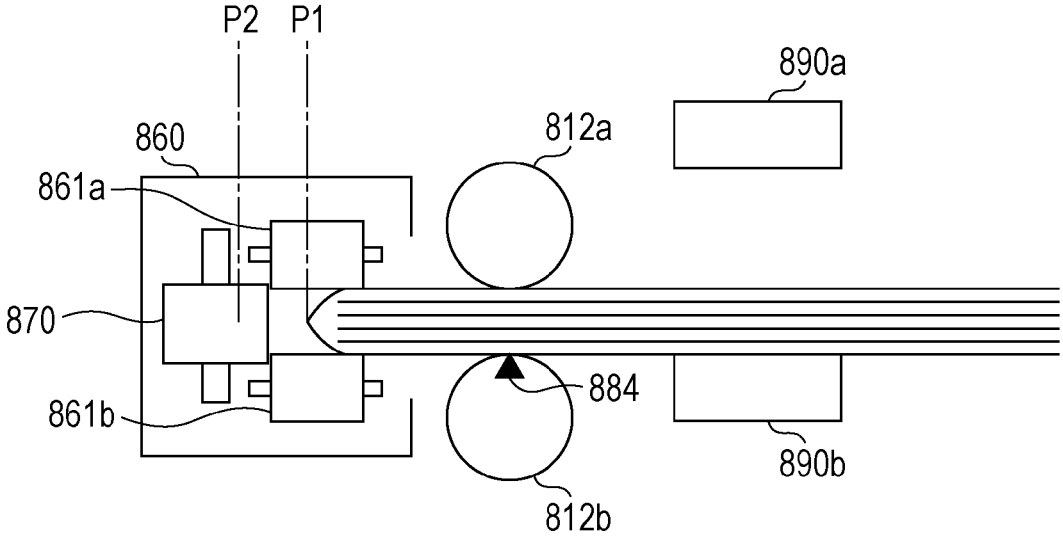
FIG. 4 is an explanatory cross-sectional view showing a pressing process in a first embodiment.

FIG. 4 is a cross-sectional view in the vicinity of the press unit 860 when performing the pressing process. At the time of the pressing process, a leading edge of the sheet bundle is stopped at the position P1. By the movement of the press unit 860 along the crease in a state in which the leading edge of the sheet bundle is stopped at the position P1, the process is performed on the folded portion of the sheet bundle by the press roller pair 861*a* and 861*b*. At this time, the clamping unit 890 waits in a state of being apart from the sheet bundle without holding the sheet bundle. The reason is that the sheet bundle needs not to be held by the clamping unit 890 because the sheet bundle is never pressed in the direction opposite from the direction of conveyance during the pressing process because of the presence of a pressing force. As another reason, holding of the sheet bundle by the clamping unit 890 must be performed after the sheet bundle is stopped. Therefore, a timing to start the movement of the press unit 860 is delayed by a time length corresponding to the operating time of the clamping unit 890.

Figure 5:
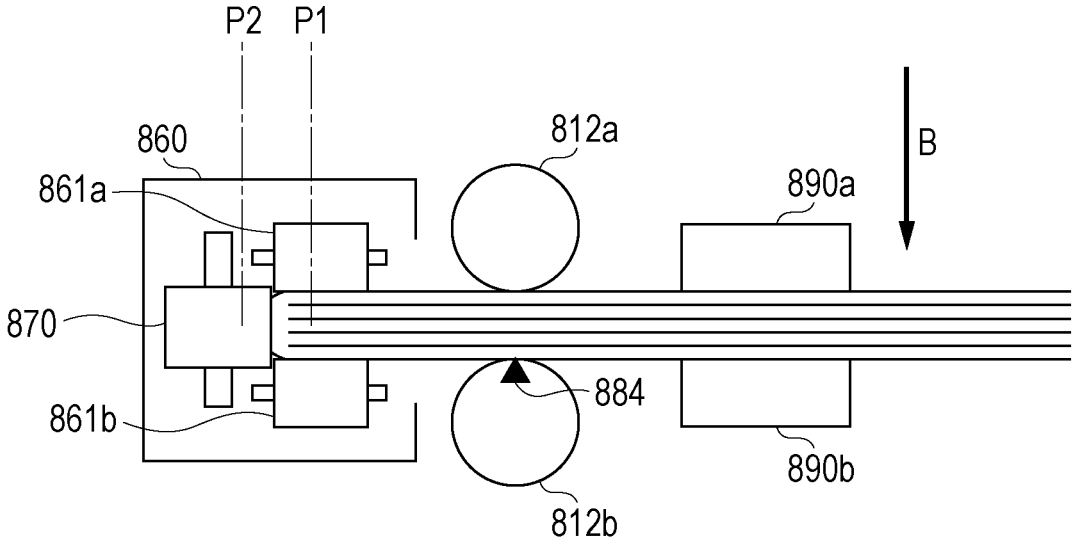
FIG. 5 is an explanatory cross-sectional view showing a flattening process in the first embodiment.

FIG. 5 is a cross-sectional view in the vicinity of the press unit 860 when performing the flattening process. At the time of the flattening process, the leading edge of the sheet bundle is stopped at the position P2. By the movement of the press unit 860 along the crease after having stopped the conveyance of the sheet bundle, the process is performed on the folded portion of the sheet bundle by the press roller pair 861*a* and 861*b* and the flattening roller 870. During the flattening process, the clamping member 890*a* moves in the direction indicated by an arrow B to hold the sheet bundle so as to prevent the sheet bundle from moving in the direction opposite from the direction of conveyance by the pressing force of the flattening roller 870.

Figure 6:
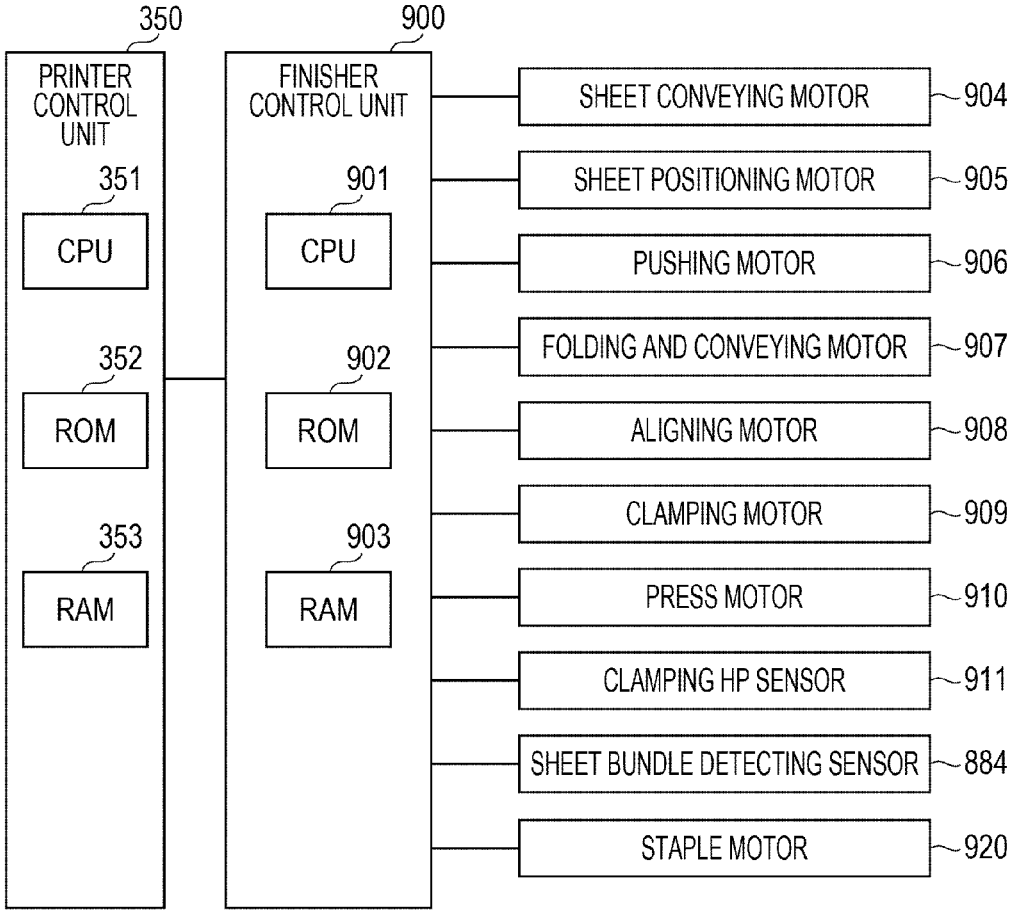
FIG. 6 is a control block diagram of the image forming system.

FIG. 6 is a control block diagram of an image forming system in FIG. 1. A printer control unit 350 includes a CPU 351, a ROM 352, and a RAM 353. A finisher control unit 900 also has a CPU 901, a ROM 902, and a RAM 903 in the same manner, and the CPU 901 controls the folding and conveying motor 907, the clamping motor 909, and a press motor 910 by a control program stored in the ROM 902. The finisher control unit 900 receives information on jobs and information on conveyed sheets from the printer control unit 350 through communication with the printer control unit 350.

Figure 7:
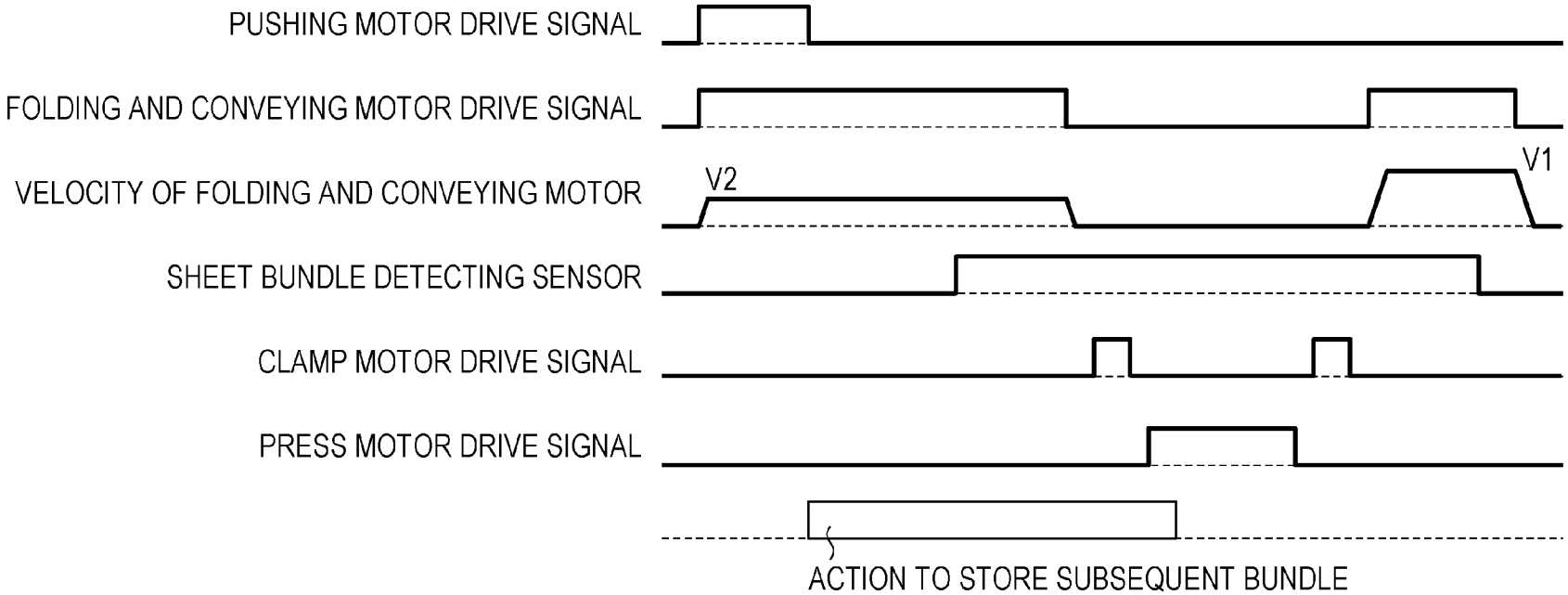
FIG. 7 is a timing chart showing the flattening process in the first embodiment.

FIG. 7 is a timing chart showing actions during the flattening process. When a plurality of sheets which constitute the sheet bundle are stored in the storage guide 803 and stapled, and a pushing motor drive signal and a folding and conveying motor drive signal are turned on, pushing, folding and conveyance of the sheet bundle is started. After the sheet bundle detecting sensor 884 is turned on, the sheet bundle is conveyed by a predetermined distance, and then the folding and conveying motor drive signal is turned off, so that the conveyance of the sheet bundle is stopped. In order to stabilize the amount of flattening the crease, a velocity of conveyance of the sheet bundle when the flattening process is performed is set to be a velocity V2, which is slower than the velocity of conveyance when the flattening process is not performed. Accordingly, the sheet bundle is stopped at the position P2 with high degree of accuracy. After having stopped the sheet bundle, an output of a clamp motor drive signal is produced, and hence a clamping operation is performed. Consequently, an output of a press motor drive signal is produced, and hence the flattening process is performed. After the flattening process, the output of the clamp motor drive signal is produced again, and holding of the sheet bundle by the clamping unit 890 is released. Subsequently, the output of the folding and conveying motor drive signal is produced again, and the sheet bundle is discharged at a velocity V1, which is faster than the velocity V2. After having finished the pushing and folding, sheets which constitute a subsequent sheet bundle are stored in the storage guide 803, and preparation of the subsequent process is performed.

Figures 8A, 8B:
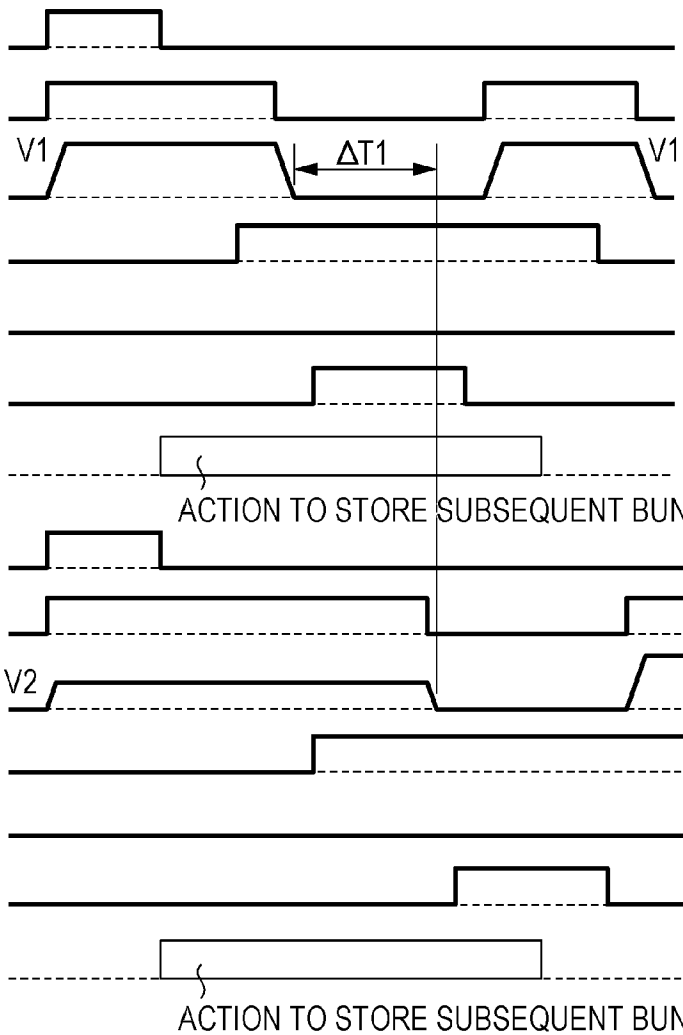
FIG. 8A and FIG. 8B are timing charts showing the pressing processes in the first embodiment and a comparative example.

FIG. 8A is a timing chart showing an action during the pressing process in this embodiment. A series of actions until the stop of the sheet bundle in the same manner as the flattening process are performed. The velocity of conveyance of the sheet bundle is set to V1 (>V2) during the pressing process, and the sheet bundle is controlled to stop at the position P1 of the pressing process. With the press motor drive signal turned on after having stopped the sheet bundle, the pressing process is performed for the folded portion of the sheet bundle. After having ended the pressing process, the folding and conveying motor drive signal is turned on again, and the sheet bundle is discharged.

FIG. 8B is a timing chart showing a case where the sheet bundle is conveyed at the velocity of conveyance V2 during the pressing process. Since the velocity of conveyance is slower, the time length until the sheet bundle is stopped is increased by a length ΔT1 in comparison with FIG. 8A correspondingly. Therefore, the entire processing time is increased by the amount corresponding to ΔT1. As shown in FIG. 8B, if the sheet bundle is conveyed during the pressing process at the similar velocity of conveyance of the sheet bundle to that during the flattening process, lowering of productivity is resulted.

Figure 9:
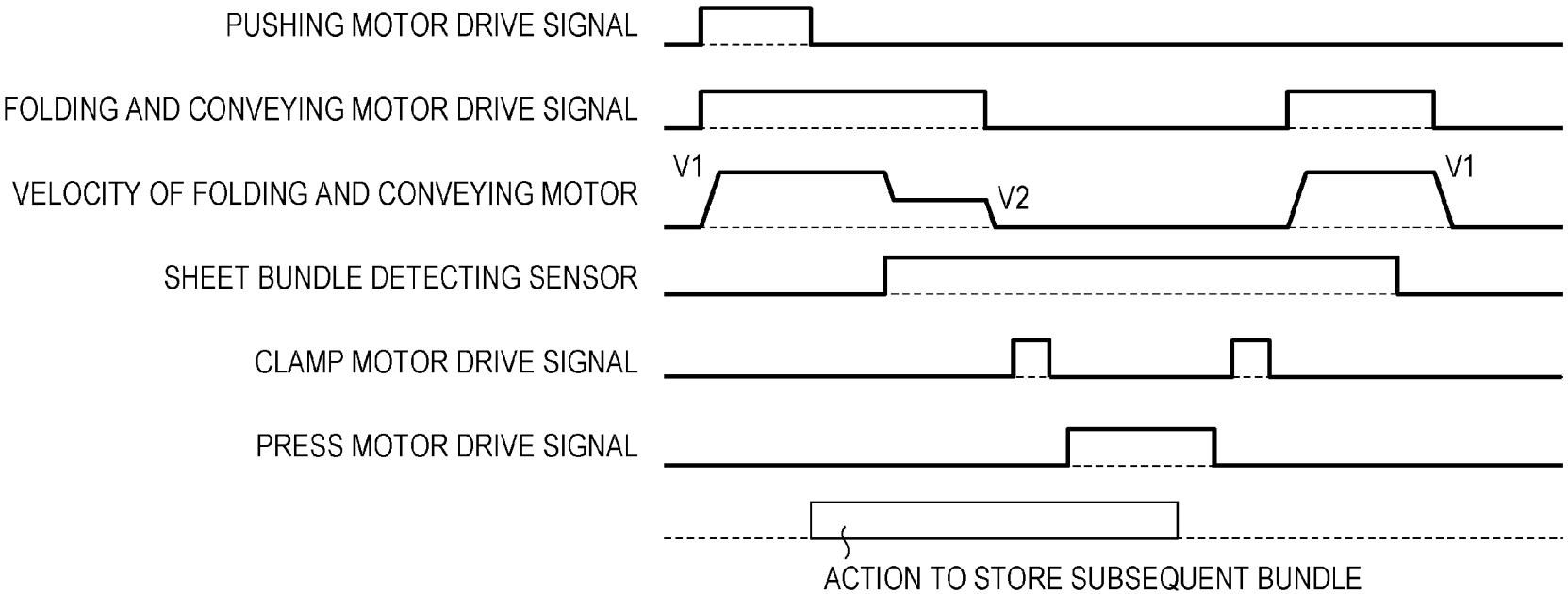
FIG. 9 is a timing chart showing the flattening process in the first embodiment.

Although the velocity of conveyance of the sheet bundle during the flattening process has described as being constant at V2 in FIG. 7, the sheet bundle may be conveyed at the velocity V1 partway because the constant velocity of conveyance must simply be the velocity V2 immediately before the sheet bundle stops at the position P2 of the flattening process. The timing chart in this case is shown in FIG. 9. As shown in FIG. 9, the sheet bundle is conveyed at the velocity V1 when the pushing and folding are started, then is conveyed at the velocity V2 after a predetermined period of time and, after having conveyed at the constant velocity V2 for the predetermined period of time, the sheet bundle is stopped. Even in the control of the velocity of conveyance of the sheet bundle as described above, an equivalent accuracy of the stop position to the timing chart shown in FIG. 7 can be realized.

Figure 10A:
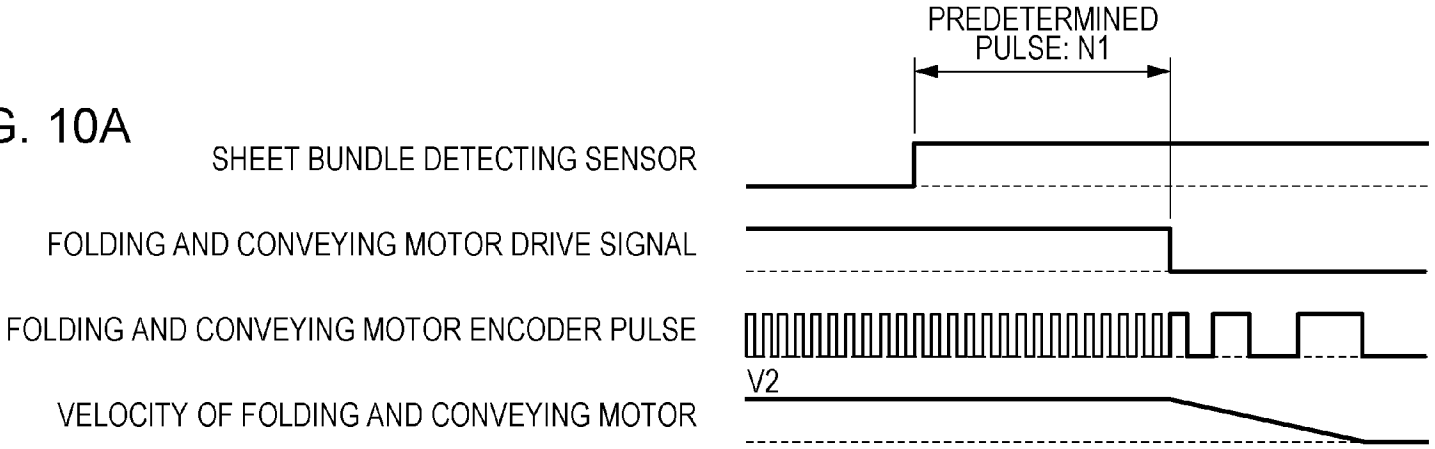
FIGS. 10A and 10B are timing charts explaining a sheet bundle stop position in the first embodiment.

The accuracy of the stop position of the sheet bundle will be described with reference to FIGS. 10A and 10B. FIG. 10A is a drawing showing a stopping action during the flattening process. During the flattening process, the sheet bundle is conveyed at the velocity V2 and the sheet bundle detecting sensor 884 detects the leading edge of the sheet bundle, then the CPU 901 of the finisher control unit 900 counts N1 encoder pulses of the folding and conveying motor 907, and then puts a brake on the folding and conveying motor 907 to stop the sheet bundle at the position P2 of the flattening process. Since the velocity of conveyance during the flattening process is set to the velocity V2, which is slower than the velocity V1, an overrun distance from turning OFF of the folding and conveying motor drive signal until the actual stop of the folding and conveying motor 907 is shorter than the case of stopping from the velocity V1, whereby variations of the stop position are also reduced.

Figure 10B:
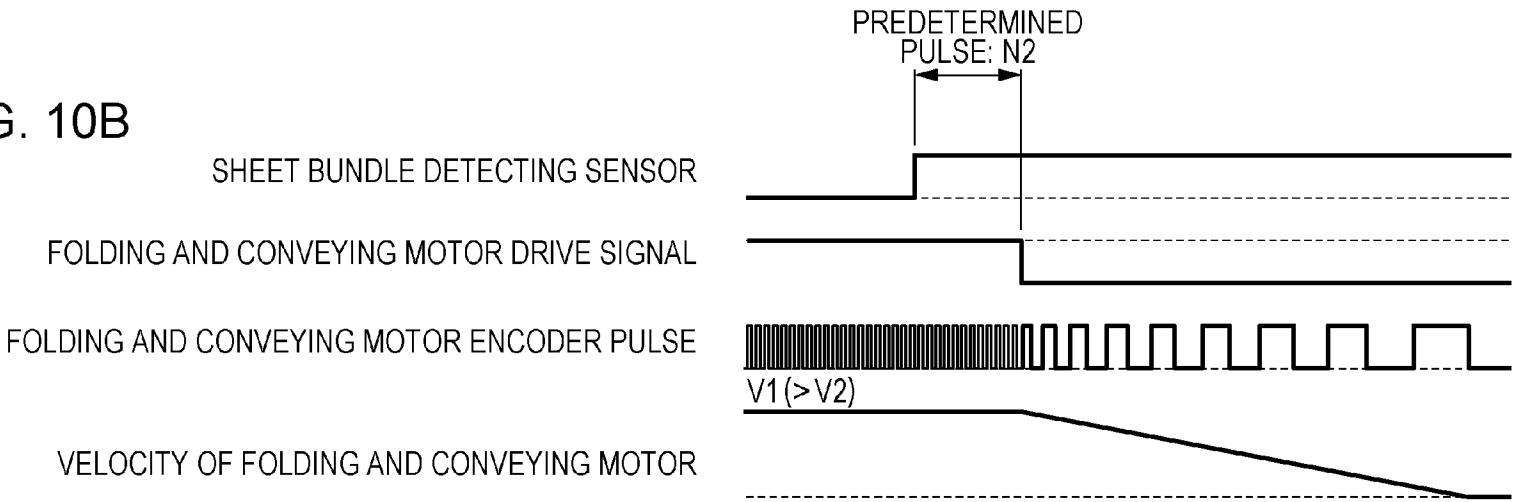

FIG. 10B is a drawing showing a stopping action during the pressing process. During the pressing process, the sheet bundle is conveyed at the velocity V1 (>V2) and the sheet bundle detecting sensor 884 detects the leading edge of the sheet bundle, then the CPU 901 counts N2 encoder pulses of the folding and conveying motor 907, and then puts a brake on the folding and conveying motor 907 to stop the sheet bundle at the position P1 of the pressing process. During the pressing process, the folded portion, which is the leading edge of the sheet bundle, only has to stop within a width in the axial direction of the press roller pair 861 without coming contact with the flattening roller 870, and hence an accuracy of stoppage does not have to be as high as during the flattening process.

In this embodiment, processing time required for the pressing process is reduced by setting the velocity V1 to 300 mm/s, and the velocity V2 to 200 mm/s.

Figure 11:
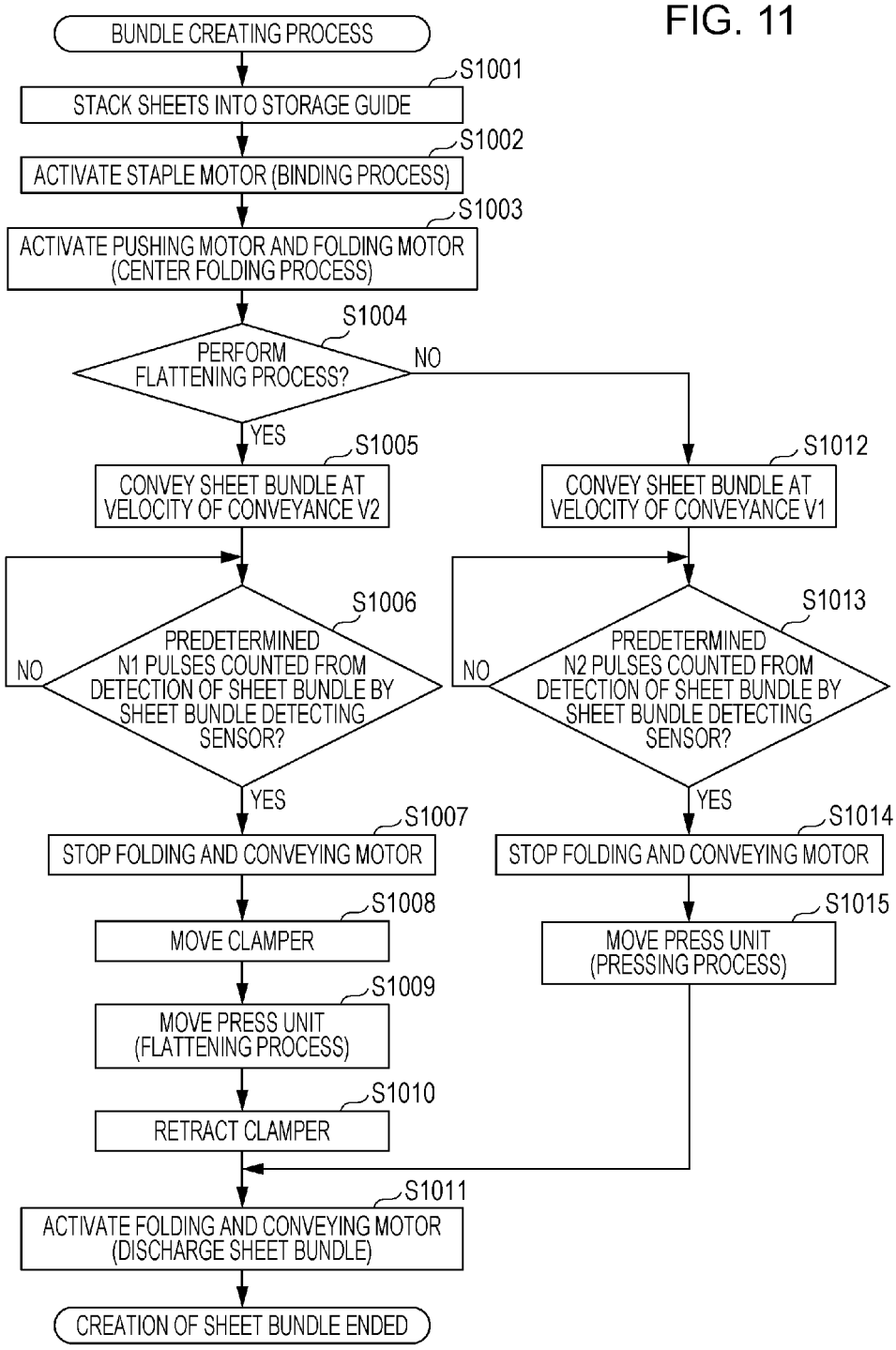
FIG. 11 is a flowchart showing a sheet bundle creating process in the first embodiment.

With reference to FIG. 11, a process of creating the sheet bundle by the finisher control unit 900 will be described. The process of the flowchart in FIG. 11 is performed by the CPU 901 of the finisher control unit 900. The CPU 901 conveys sheets discharged from the printer 300 and stores the sheets in the storage guide 803 of the saddle-stitch binding unit 800 (S1001). When a plurality of the sheets which constitute the sheet bundle are stored in the storage guide 803, the CPU 901 drives a staple motor 920 and performs the binding process on the sheet bundle (S1002). After having ended the binding process, the CPU 901 conveys the sheet bundle to the folding position, and drives the pushing motor 906 and the folding and conveying motor 907 to perform a center folding process (S1003). The CPU 901 determines whether or not the flattening process is performed on the basis of the information on the setting of the flattening process obtained from the printer control unit 350 (S1004). When the flattening process is set to be performed in S1004, the CPU 901 sets the velocity of conveyance by the folding and conveying motor 907 to the velocity V2, and causes the sheet bundle to be conveyed (S1005). When the sheet bundle is conveyed and the sheet bundle detecting sensor 884 detects the sheet bundle, the CPU 901 determines whether or not N1 pulses from the encoder provided on the folding and conveying motor 907 are counted (S1006). When the N1 encoder pulses are counted, the CPU 901 stops the folding and conveying motor 907 for stopping the sheet bundle at the flattening position P2 (S1007).

Subsequently, the CPU 901 activates the clamping motor 909 for causing the sheet bundle to be held by the clamping unit 890 (S1008). The amount of driving of the clamping motor 909 is determined according to the number of sheets and the thickness of the sheet, and is controlled to provide just the right amount of force to hold the sheet bundle. Data about the number of sheets and the thickness of the sheet are transmitted from the printer control unit 350. When the holding by the clamping unit 890 is completed, the CPU 901 activates the press motor 910 and moves the press unit 860 (S1009). By the movement of the press unit 860, the flattening process and the pressing process are performed on the sheet bundle stopped at the flattening position P2. When the movement of the press unit 860 is completed, the CPU 901 activates the clamping motor 909 and retracts the clamping unit 890 (S1010). When the clamp is retracted, the CPU 901 drives the folding and conveying motor 907 at the velocity V1, and discharges the sheet bundle (S1011). A velocity of discharge of the sheet bundle after having performed the flattening process does not have to be the velocity V1 but only has to be a velocity faster than the velocity V2. The velocity of discharge of the sheet bundle after the pressing process without having performed the flattening process only has to be a velocity not lower than the velocity V1. Accordingly, the flattening process or the pressing process with respect to the subsequent sheet bundle can be started early.

When it is determined that the flattening process is not to be performed in S1004, the CPU 901 sets the velocity of conveyance by the folding and conveying motor 907 to the velocity V1, and causes the sheet bundle to be conveyed (S1012). When the sheet bundle is conveyed and the sheet bundle detecting sensor 884 detects the sheet bundle, the CPU 901 determines whether or not N2 pulses from the encoder provided on the folding and conveying motor 907 are counted since the time point when the sheet bundle is detected (S1013). When the N2 encoder pulses are counted, the CPU 901 stops the folding and conveying motor 907 for stopping the sheet bundle at the pressing position P1 (S1014). When the sheet bundle stops at the position P1, the CPU 901 activates the press motor 910 and moves the press unit 860 (S1015). By the movement of the press unit 860, the pressing process is performed on the sheet bundle stopped at the pressing position P1. When the pressing process is ended, the CPU 901 discharges the sheet bundle as described above.

As described above, by setting the velocity of conveyance of the sheet bundle to a low velocity during the flattening process in comparison with the velocity during the pressing process, improvement of the accuracy of stoppage of the sheet bundle to the position of the flattening process is achieved. Consequently, quality deliverables are obtained without bulge of the folded portion of the sheet bundle.

In this embodiment, although the press unit is configured to perform the pressing process in parallel with the flattening process, a configuration in which the pressing process is not performed in parallel with the flattening process is also applicable.

Second Embodiment

In a second embodiment, the sheet bundle is held by the clamping unit 890 also during the pressing process. Since a configuration of hardware of the apparatus and the process to be performed during flattening are the same as those in the first embodiment, overlapped description will be omitted.

Figure 12:
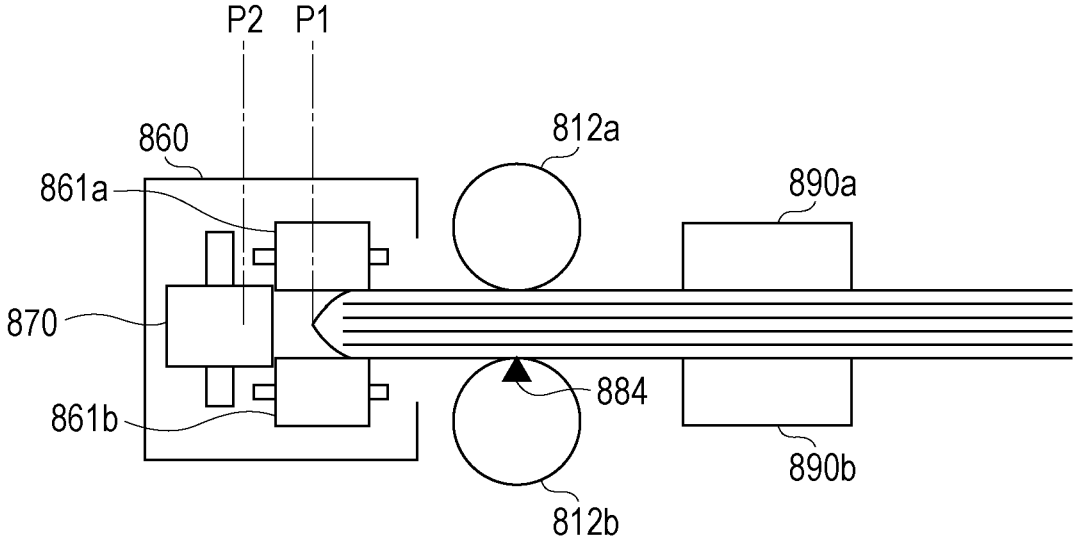
FIG. 12 is an explanatory cross-sectional view showing a pressing process in a second embodiment.

Referring now to FIG. 12, actions during the pressing process in the second embodiment will be described. During the pressing process, the sheet bundle is not clamped over the entire width (axial direction) of the press roller pair 861, but is clamped only over part of the width of the press roller. Therefore, when the number of sheets which constitute the sheet bundle is increased, the pressing force may also act in the direction of conveyance of the sheet. Consequently, the front cover may be pulled in the direction of conveyance and may be torn at a bound position. Therefore, when the number of sheets which constitute the sheet bundle is a predetermined number (for example, 20 sheets) or more, tearing of the front cover of the sheet bundle is prevented by holding the sheet bundle by the clamping unit 890 during the pressing process as well.

Figures 13A, 13B:
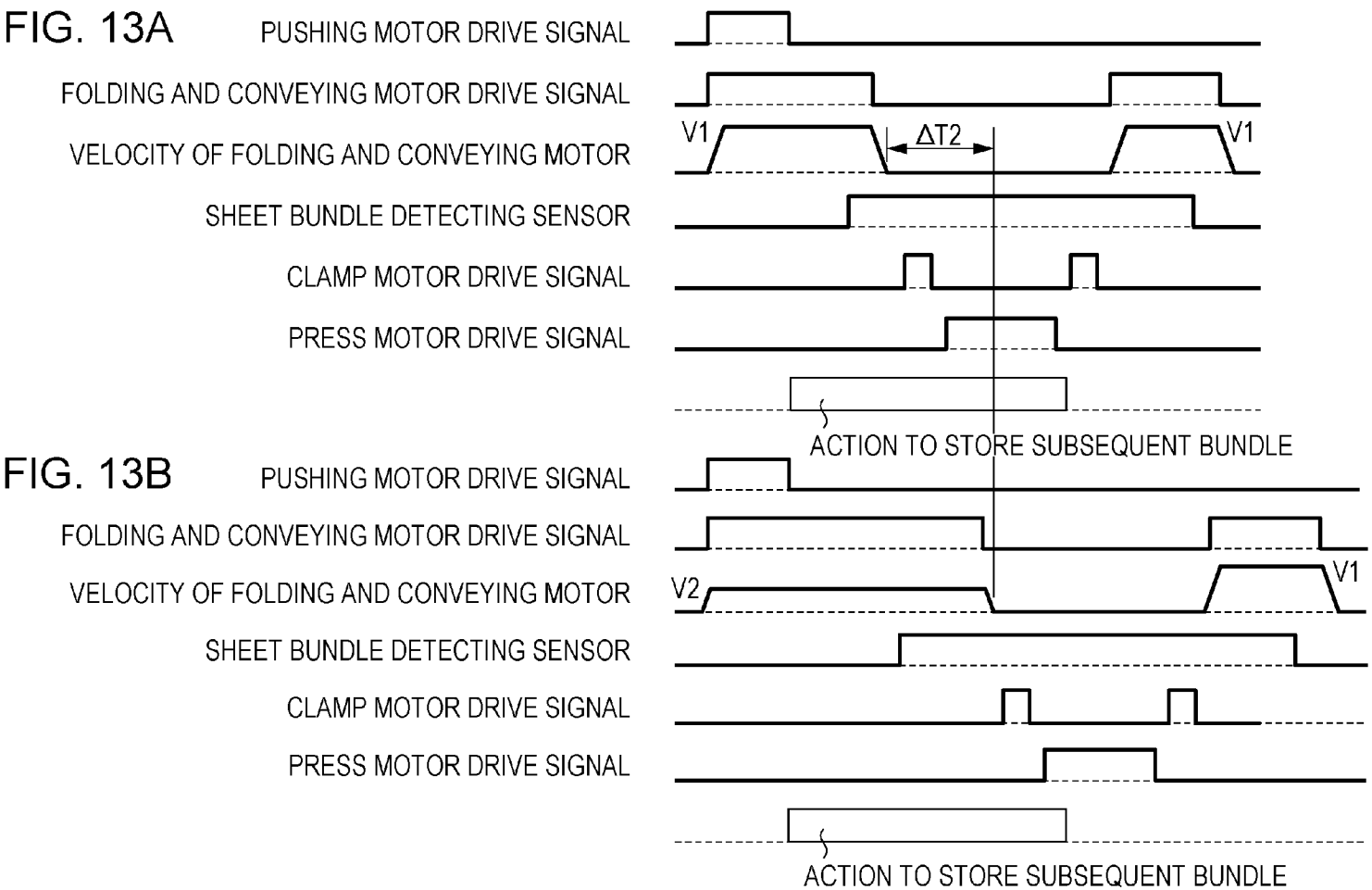
FIGS. 13A and 13B are timing charts showing the pressing processes in the second embodiment and a comparative example.

FIG. 13A is a timing chart when the clamping action is performed during the pressing process. The velocity of conveyance of the sheet bundle is set to the velocity V1 in the same manner as the first embodiment. FIG. 13B is a timing chart when the velocity of conveyance of the sheet bundle is set to the velocity V2, which is the same as the velocity as during the flattening process. Although the productivity is lowered due to the processing time required for holding the sheet bundle by the clamping unit 890, the lowering of the productivity may be reduced by time corresponding to $\Delta T2$ (*equal to $\Delta T1$) by increasing the velocity of discharge of the sheet bundle.

Figure 14:
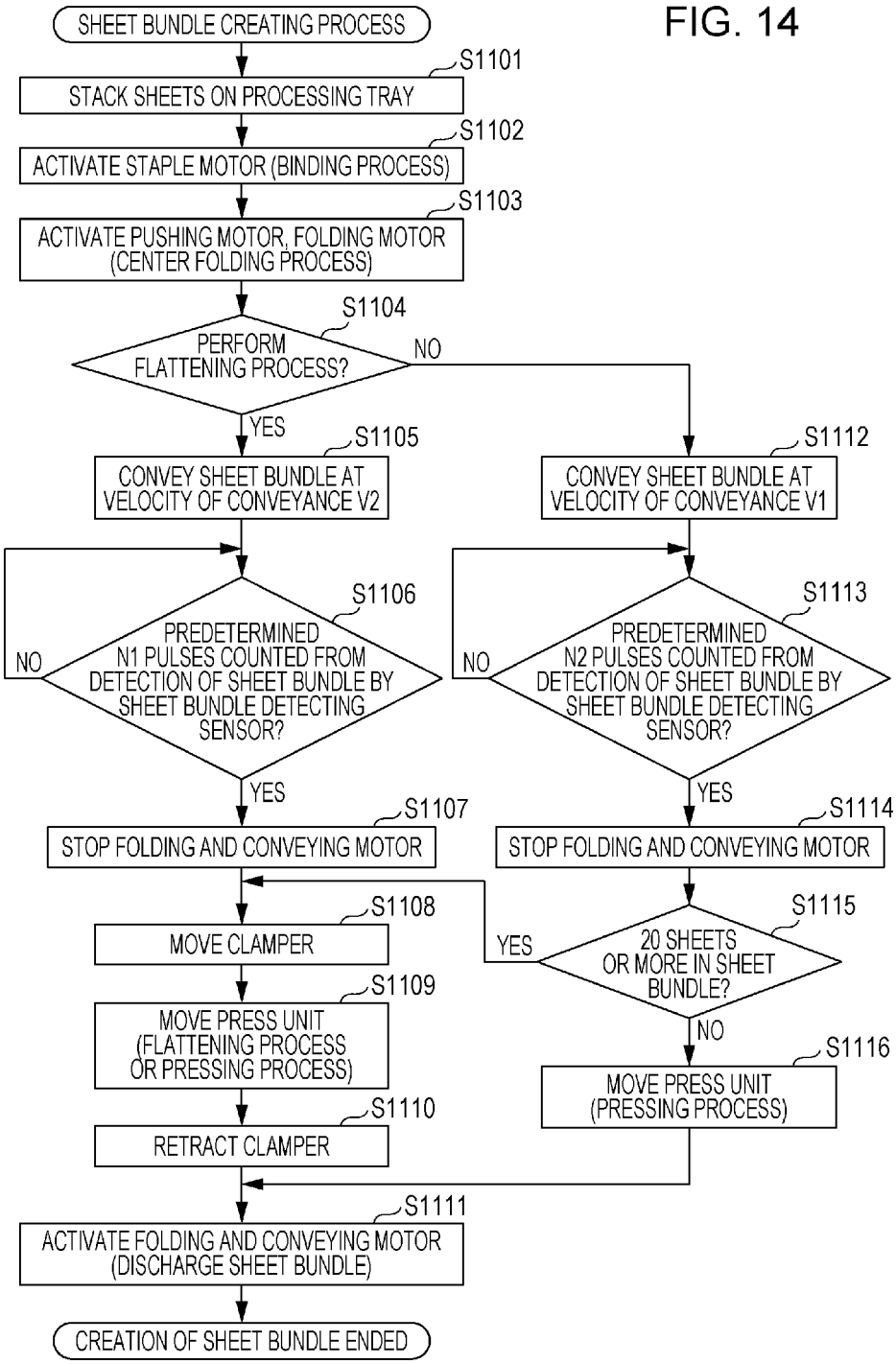
FIG. 14 is a flowchart showing a sheet bundle creating process in the second embodiment.

With reference to FIG. 14, the process of creating the sheet bundle by the finisher control unit 900 will be described. The process of the flowchart in FIG. 14 is performed by the CPU 901 of the finisher control unit 900. Since the processes from S1101 to S1113 are the same as the processes from S1001 to S1014 in FIG. 11, the description will be omitted.

When the flattening process is not set to be performed, the CPU 901 determines whether or not the number of sheets which constitute the sheet bundle is 20 sheets or more after having stopped the folding and conveying motor 907 in S1114 (S1115). If the number of sheets is 20 sheets or more, the CPU 901 performs the processes from S1108 onward in the same manner as during the flattening process. In contrast, if the number of sheets is smaller than 20, the CPU 901 activates the press motor 910 and moves the press unit 860 (S1116). When the movement of the press unit 860 is completed, the CPU 901 discharges the sheet bundle in the same manner as during the flattening process.

As described above, even when the pressing process is performed without performing the flattening process, if the number of sheets is the predetermined number of sheets or more, the sheet bundle is prevented from tearing at the bound portion by being pulled by holding the sheet bundle with the clamping members.

When a color density of the sheet bundle at a portion coming into contact with the press roller pair 861 is equal to or higher than a predetermined concentration, that is, when the amount of toner of the image on the sheet bundle is equal to or more than the predetermined amount, the press roller pair 861 is liable to stick the toner on the sheet bundle. In this case as well, the bound portion of the sheet bundle may be pulled, and hence the probability of tearing of the sheet bundle is conceivable. Therefore, when data on the amount of toner at the portion coming into contact with the press roller pair 861 is received from the printer control unit 350 and, when the received data on the amount of toner is equal to or larger than a predetermined value, the sheet bundle may be held by the clamping unit 890 even during the pressing process.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-272700 filed Dec. 7, 2010, which is hereby incorporated by reference herein in its entirety.

What is claimed is:

1. A sheet bundle treatment apparatus comprising:

a folding device configured to perform a folding process on a sheet bundle including a plurality of sheets to produce a folded sheet bundle;

a conveying unit configured to convey the folded sheet bundle;

a flattening device configured to perform a flattening process to press a folded portion of the sheet bundle from the folded portion toward a fore edge to flatten the folded portion after the conveyance of the sheet bundle by the conveying unit; and a control unit configured to cause the sheet bundle to be conveyed at a first velocity when the flattening process is not to be performed, and to cause the sheet bundle to be conveyed at a second velocity which is slower than the first velocity when the flattening process is to be performed, thereby controlling the conveying unit to stop the sheet bundle at a position where the flattening process is to be performed.

2. The sheet bundle treatment apparatus according to claim 1, wherein the control unit controls the conveying unit so that a constant velocity of conveyance before stopping the conveyance of the sheet bundle becomes the second velocity of conveyance when the flattening process is to be performed, and controls the conveying unit so that the constant velocity of conveyance before stopping the conveyance of the sheet bundle becomes the first velocity of conveyance when the flattening process is not to be performed.

3. The sheet bundle treatment apparatus according to claim 1, further comprising:

a pressing device configured to perform a pressing process to fortify a crease of the folded portion of the sheet bundle by holding and pressing the folded portion of the sheet bundle from both surfaces of the sheet bundle by a roller pair after the conveyance of the sheet bundle by the conveying unit, wherein the control unit controls the conveying unit to convey the sheet bundle at the first velocity of conveyance when performing the pressing process without performing the flattening process.

4. The sheet bundle treatment apparatus according to claim 3, wherein the roller pair of the press device is arranged so that an axial direction of the roller pair matches a direction of conveyance of the sheet bundle by the conveying unit.

5. The sheet bundle treatment apparatus according to claim 1, wherein the control unit controls the conveying unit to convey the sheet bundle at a velocity faster than the second velocity after having ended the flattening process.

6. The sheet bundle treatment apparatus according to claim 1, further comprising:

a sensor configured to detect the sheet bundle conveyed by the conveying unit; and a pulse generating unit configured to generate pulses synchronous with the conveyance of the sheet bundle by the conveying unit, wherein, in response to a predetermined number of pulses being generated from the pulse generating unit after detection of the sheet bundle by the sensor, the control unit stops an operation of the conveying unit.

7. The sheet bundle treatment apparatus according to claim 1, wherein the control unit controls the conveying unit so as to convey the sheet bundle having been subjected to the folding process by the folding device at the first velocity, and then convey the sheet bundle at the second velocity when the flattening process is to be performed.

* * * * *